United States Patent [19]

Lepper et al.

[11] Patent Number: 4,608,202

[45] Date of Patent: Aug. 26, 1986

[54] PROCESS FOR THE PRODUCTION OF FATTY ACID ESTERS OF SHORT-CHAIN ALIPHATIC ALCOHOLS FROM FATS AND/OR OILS CONTAINING FREE FATTY ACIDS

[75] Inventors: Herbert Lepper, Duesseldorf-Benrath; Lothar Friesenhagen, Duesseldorf, both of Fed. Rep. of Germany

[73] Assignee: Henkel Kommanditgesellschaft auf Aktien, Duesseldorf, Fed. Rep. of Germany

[21] Appl. No.: 599,090

[22] Filed: Apr. 11, 1984

[30] Foreign Application Priority Data

May 30, 1983 [DE] Fed. Rep. of Germany ..... 3319590

[51] Int. Cl.[4] ..... C11C 3/02

[52] U.S. Cl. ..... 260/410.9 R; 560/234

[58] Field of Search ..... 260/410.9 E; 560/263, 560/265, 234

[56] References Cited

U.S. PATENT DOCUMENTS

| | | | |
|---|---|---|---|
| 1,421,605 | 7/1922 | Steffens | 560/265 |
| 1,651,666 | 12/1922 | Buc | 560/265 |
| 2,383,632 | 10/1942 | Trent | 260/410.9 E |
| 2,469,371 | 8/1946 | Colbeth | 260/410.9 E |
| 3,692,822 | 9/1972 | Hay et al. | 560/265 |
| 4,082,788 | 4/1978 | Mims | 560/265 |
| 4,164,506 | 8/1979 | Kawahara et al. | 260/410.9 |

OTHER PUBLICATIONS

European Search Report.

*Primary Examiner*—Michael L. Shippen

*Attorney, Agent, or Firm*—Ernest G. Szoke; Henry E. Millson, Jr.; Mark A. Greenfield

[57] ABSTRACT

For the production of fatty acid esters of short-chain, aliphatic alcohols by the catalytic transesterification of natural fats and/or oils containing free fatty acids (oil phase) with the corresponding monoalcohols, the oil phase is subjected to preliminary esterification with the monoalcohols in the presence of acidic esterification catalysts at temperatures no higher than 120° C. and under pressures no higher than 5 bars and in the presence of a liquid entraining agent substantially immiscible with the oil phase, after which the reaction product is separated into an entraining agent phase containing the acidic catalyst and water of reaction and the treated oil phase, the oil phase is then subjected to transesterification while the acidic catalyst-containing entraining agent phase is returned, after at least partial drying, to the preliminary esterification stage. By this process, fats and/or oils with acid numbers of up to 60 can be processed in the preliminary esterification stage to give an oil phase having a low acid number.

20 Claims, No Drawings

PROCESS FOR THE PRODUCTION OF FATTY ACID ESTERS OF SHORT-CHAIN ALIPHATIC ALCOHOLS FROM FATS AND/OR OILS CONTAINING FREE FATTY ACIDS

BACKGROUND OF THE INVENTION

Fatty acid esters of short-chain aliphatic alcohols, particularly those containing up to 4 carbon atoms, and above all, fatty acid methyl esters have acquired considerable commercial significance. For example, they are important starting materials for the production of fatty alcohols, and are also used for the production of other oleochemical products, for example soaps, tensides, alkanolamides, etc.

On an industrial scale, fatty acid esters of lower alcohols are mainly produced by alcoholysis of the corresponding fats and/or oils of natural origin which, as already known, are fatty acid triglycerides. However, vegetable and/or animal fats and oils almost always contain considerable quantities of free fatty acids, this content of free acids being variable over a wide range, depending on the origin of the material and its previous history. The content of free fatty acids is almost always above 3% by weight. The acid number of the commercially available, crude coconut oil is normally not above 10–20. The acid number of other vegetable oils, particularly those of good quality, is below 10, poorer qualities having acid numbers of, for example, from 20 to 25. Commercial-grade tallows, which are valued and handled according to their acid number, generally have free fatty acid contents, depending on their quality, of from 1 to 15–20% by weight, corresponding to an acid number of from about 30 to 40 and, in some cases, even higher.

The acid number of the triglyceride used for transesterification has a very considerable bearing upon the possibilities and process conditions of the transesterification reaction.

Accordingly, the production of fatty acid esters on an industrial scale by the alcoholysis of fats and/or oils may be carried out by various methods:

In the presence of alkali catalysts, neutral fats may be smoothly converted into the corresponding alkyl esters with a 50 to 100% excess over and above the stoichiometrically necessary quantity of alcohol at temperatures as low as 30° to 70° C. In this case, however, it is only possible smoothly to react fats and oils of which the free fatty acid content is below 0.5% by weight, corresponding to an acid number of the triglycerides of approximately 1 and lower.

The Bradshaw process used in industry is based, for example, on the alkali-catalyzed transesterification of fats, of which the acid number should not be above 1.5, with methyl alcohol as the first stage of a continuous soap manufacturing process, cf. for example Ullmann, Enzyklopadie der technischen Chemie. 3rd Edition, Vol. 7, pages 525 et seq; 4th Edition, Vol. 11, pages 490 et seq.

By means of another industrial process (cf. Ullmann loc. cit., 4th Edition, Vol. 11, page 432), it is even possible to transesterify fats and oils having higher acid numbers. In this process, however, the production of fatty acid methyl esters is carried out at 240° C. under elevated pressure (approximately 100 bars) in the presence of alkali or zinc catalysts with a large excess of methanol (7 to 8-fold molar excess).

On account of the almost always considerable content of free fatty acids in commercial fats and oils of natural origin, pressureless transesterification (which is advantageous in terms of energy by virtue of the lower temperatures involved and the distinctly lower methanol demand and which does not require the use of pressure reactors) presupposes a reduction in the acid number, for example by preliminary conversion of the free fatty acids into the corresponding alkyl or glycerol esters.

According to Ullmann, loc. cit. 4th Edition, Vol. 11, page 432, this preliminary esterification reaction may be carried out at 240° C.20 bar in the presence of alkali catalysts. In this case, too, expensive pressure reactors have to be used for the preliminary esterification with methanol and other short-chain alcohols.

OBJECTS OF THE INVENTION

The object of the present invention is to make it easier to produce fatty acid esters of lower monoalcohols from triglyceride starting materials which contain considerable quantities of free fatty acids. Starting out from the combination of preliminary esterification of the free fatty acids with subsequent transesterification, it is an object to be able to carry out both stages of the process at comparatively low temperatures and without using reactors designed for relatively high pressures.

A further object of the present invention is to reduce the large excess of alcohol which is required, for example, where transesterification is carried out under pressure and which, beyond the necessary working up and purification steps, represents a significant cost factor.

In overall terms, therefore, the invention seeks to enable fatty acid esters of lower alcohols to be produced inexpensively both in terms of energy and costs from starting materials of precisely the type which are based on natural, particularly vegetable and/or animal fats and/or oils.

A yet further object of the present invention is the development of a process for the production of fatty acid esters of $C_{1-6}$ aliphatic monoalcohol by catalytic transesterification consisting essentially of the steps of (a) subjecting natural fats and/or oils containing free fatty acids, as an oil phase, having an acid number of over 1, to preliminary esterification with a $C_{1-6}$ aliphatic monoalcohol in the presence of at least one acidic esterification catalyst at an elevated temperature no higher than 120° C. and under a pressure no higher than 5 bars, in the presence of a liquid entraining agent substantially immiscible with said oil phase, for a time sufficient to reduce the free fatty acid content of said oil phase to an acid number of 1 or below, (b) separating the reaction product by phase separation into an entraining agent phase containing the acidic esterification catalyst and the water of reaction, and the treated oil phase, (c) subjecting the separated treated oil phase to transesterification with a $C_{1-6}$ aliphatic monoalcohol under conventional transesterification conditions and recovering said fatty acid esters of $C_{1-6}$ aliphatic monoalcohols and (d) partially to wholly removing the water of reaction from said entraining agent phase and recycling said dried entraining agent phase containing the acidic esterification catalyst to a further preliminary esterification step.

These and other objects of the invention will become more apparent as the description thereof proceeds.

DESCRIPTION OF THE INVENTION

To achieve these objects, the invention provides a process for the production of fatty acid esters of short-chain aliphatic alcohols by the catalytic transesterification of fats and/or oils containing free fatty acids (oil phase) with the corresponding monoalcohols, which is characterized in that the oil phase is subjected to preliminary esterification with the monoalcohols in the presence of acid esterification catalysts at temperatures no higher than 120° C. under pressures no higher than 5 bars and in the presence of a liquid entraining agent substantially immiscible with the oil phase, after which the reaction product is separated by phase separation into an entraining agent phase containing the acid catalyst and the water of reaction and the treated oil phase, this oil phase being used for transesterification while the catalyst-containing entraining agent phase is returned, after at least partial drying, to the preliminary esterification stage.

Accordingly, the process according to the invention comprises the following four stages:

1. Reaction of the triglyceride containing free fatty acids with the short-chain monoalcohol in the presence of an acidic catalyst, but under such process conditions that the free fatty acids of the starting material are, for the most part, selectively converted into the corresponding alkyl esters. The reaction is carried out in the presence of an entraining agent which is liquid under the process conditions and which is substantially immiscible with the triglyceride starting material. In this preliminary esterification stage of the process, it is possible without difficulty to reduce the acid number of the triglyceride to values of the order of 1 or lower under the mild conditions which will be described in more detail hereinafter.
2. Separation from the two-phase reaction mixture of the entraining agent phase which contains virtually all the catalyst used and virtually all the water of reaction formed during the esterification reaction and also the free part of the monoalcohol still present in the reaction mixture.
3. Removal of the water of reaction and, preferably, of the alcohol from the entraining agent phase, preferably by distillation, and recycling of the catalyst-containing entraining agent to the preliminary esterification stage (stage 1).
4. Subsequent transesterification of the triglyceride now having only a low free fatty acid content with the monofunctional alcohol in known manner under energy- and cost-efficient conditions; the transesterification reaction may be carried out in particular in the presence of a basic catalyst.

More particularly, the present invention relates to a process for the production of fatty acid esters of $C_{1-6}$ aliphatic monoalcohols by catalytic transesterification consisting essentially of the steps of (a) subjecting natural fats and/or oils containing free fatty acids, as an oil phase, having an acid number of over 1, to preliminary esterification with a $C_{1-6}$ aliphatic monoalcohol in the presence of at least one acidic esterification catalyst at an elevated temperature no higher than 120° C. and under a pressure no higher than 5 bars, in the presence of a liquid entraining agent substantially immiscible with said oil phase, for a time sufficient to reduce the free fatty acid content of said oil phase to an acid number of 1 or below, (b) separating the reaction product by phase separation into an entraining agent phase containing the acidic esterification catalyst and the water of reaction, and the treated oil phase, (c) subjecting the separated treated oil phase to transesterification with a $C_{1-6}$ aliphatic monoalcohol under conventional transesterification conditions and recovering said fatty acid esters of $C_{1-6}$ aliphatic monoalcohols and (d) partially to wholly removing the water of reaction from said entraining agent phase and recycling said dried entraining agent phase containing the acidic esterification catalyst to a further preliminary esterification step.

The acid number of natural, vegetable and/or animal fats and/or oils may vary over a wide range. Thus, the acid number of the standard, commercially available crude coconut oil is normally not higher than 10 to 20. The acid number of other vegetable oils is below 10 where quality is good and is in the range of, for example, from 20 to 25 where the oils are of poor quality. Commercial-grade tallows, which are valued and handled according to their acid number, have free fatty acid contents, depending on their quality, of from 1 to 15–20% by weight, corresponding to acid numbers of, for example, up to 30–40 and, in some cases, even up to 60 or even higher may be used in the process according to the invention.

The first stage of the process according to the invention comprises esterification of the free fatty acids present in the triglyceride with the short-chain monoalcohol under the accelerating effect of acidic catalysts. Preferred monoalcohols are, $C_1$–$C_4$-alkanols and, in particular, methanol. This preliminary esterification stage is best carried out with the same monoalcohol which is also to be used in the following transesterification stage. According to the invention, this preliminary esterification stage is carried out in the presence of an entraining agent which is liquid under the process conditions and substantially immiscible with the oil phase. The esterification reaction is carried out under comparatively mild conditions so that transesterification of the triglycerides with the monoalcohol takes place to only a minimal extent, if at all. The preliminary esterification step may be carried out, for example, at temperatures in the range from 40° to 120° C. and is preferably carried out at temperatures in the range from 50° to 100° C. in the absence of elevated pressure or, at most, under very slightly elevated pressures which, generally, are no higher than 5 bars. Accordingly, there is no need for pressure reactors to be used.

Suitable entraining agents are, in particular, sufficiently high-boiling, polyhydric alcohols which are liquid at 50° C. and, preferably, even at room temperature and/or ethers or partial ethers thereof. Preferably the liquid entraining agents are alcohols, liquid at 50° C., selected from the group consisting of alkanepolyols having from 2 to 6 carbon atoms and 2 to 6 hydroxyls, polyethylene glycols, ethylene glycol mono-$C_{1-6}$-alkyl ethers and diethylene glycol mono-$C_{1-6}$-alkyl ethers. Accordingly, suitable liquid entraining agents are, for example, ethylene glycol, propylene glycol, polyethylene glycols, ethylene glycol ethers, for example propoxyethanol, or di-ethylene-glycol ethers, such as methoxyethoxyethanol. However, the most suitable liquid entraining agent is glycerol. Glycerol is in any case released in the following transesterification stage. The choice of glycerol as entraining agent for the first stage of the process thus provides for distinct, further simplifications in the process.

The entraining agent serves in particular as a liquid carrier for the acidic catalyst in the first stage (preliminary esterification). In principle, it is possible to use any acidic, nonvolatile esterification catalyst, i.e. for example corresponding systems based on Lewis acids, substantially nonvolatile inorganic acids and/or their acidic partial esters, heteropolyacids and the like. One particularly suitable class of acidic catalysts are organic sulfonic acids which may be described, for example, by the general formula $RSO_3H$ where R is an alkyl, aryl or alkaryl radical. Examples of suitable sulfonic acids are methane sulfonic acid, toluene sulfonic acid, naphthalene sulfonic acid or alkylbenzene sulfonic acid. Sulfuric acid, for example, or semiesters thereof may be used as the substantially nonvolatile inorganic acid. Suitable heteropolyacids are, for example, phosphotungstic or phosphomolybdic acids.

The reaction of the free fatty acids with the monoalcohols is the fastest reaction occurring under the conditions selected in accordance with the invention for the preliminary esterification stage, so that not only the transesterification of the triglycerides with the monoalcohol, but also the reaction of the free fatty acids with the entraining agent used, such as glycerol, takes place to a negligible extent, if at all.

The glycerol added during the preliminary esterification stage, or the other entraining agent mentioned, perform a very important function in the process according to the invention. Under the selected reaction conditions, glycerol, or other entraining agents, is soluble in triglycerides to only a very minimal extent. On the other hand, the acidic esterification catalysts and also the water of reaction formed during the esterification reaction dissolve very much better in glycerol, or other entraining agents mentioned, than in the triglycerides. The result of this is that, on completion of the esterification reaction, virtually all the acidic esterification catalyst used and the water of reaction formed are contained in the entraining agent phase. Accordingly, the oil phase is substantially free from acidic catalyst and water of reaction, both of which would adversely affect the further reaction in the following alkali-catalyzed transesterification reaction.

Following its removal from the first process stage, the catalyst-containing glycerol phase may be freed from water of reaction and, if desired, from excesses of alcohol by simple distillation, so that the catalystcontaining glycerol phase may be recycled to the preliminary esterification stage. Accordingly, the glycerol—or, more properly, the entraining agent immiscible with the oil phase—effectively serves as a liquid support for the catalyst used and removes the water of reaction formed in the first stage of the process from the oil phase.

Under the above-described mild conditions of the first stage of the process, the quantity of entraining agent, particularly glycerol, used and recycled remains free fatty acids has not yet taken place.

The quantity of acidic catalyst used in the preliminary esterification stage influences the velocity of the esterification reaction to a certain extent. Since, according to the invention, the catalyst may be recovered substantially quantitatively and recycled without difficulty, there is no need for the quantity of catalyst to be limited for reasons of cost. In general, the acidic esterification catalyst is used in quantities of from 0.5 to 5.0% by weight, based on the oil phase used. However, the catalyst may also be used in smaller or larger quantities.

The quantity of the entraining agent employed is also not affected by cost considerations because the entraining agent is recovered substantially quantitatively and recycled. However, the following aspect is of importance: the quantity of the entraining agent, such as glycerol for example, employed should be coordinated with the quantity of the monohydric alcohol employed in the preliminary esterification stage in such a way that the difference in density between the oil phase and the entraining agent phase on completion of the preliminary esterification stage should be sufficient for satisfactory phase separation. A characteristic density value for the oil phase is, for example, 0.88. Methanol has a density of 0.79 and glycerol a density of 1.25. Methanol and glycerol are homogeneously miscible; the water of reaction and the acidic catalyst additionally increase this phase. In general, therefore, the two-phase reaction product from the preliminary esterification stage will contain the oil phase as its upper phase and the entraining agent phase as its lower phase. If necessary, it is possible by simple preliminary tests to determine the most favorable ratios for mixing the monoalcohol and the entraining agent, particularly glycerol, for facilitating phase separation on completion of the preliminary esterification stage. The following mixing ratios are preferably applied: the liquid entraining agent is normally used in a quantity of from 5 to 50 parts by volume and, more particularly, in a quantity of from 5 to 25 parts by volume to 100 parts by volume of oil phase, while at the same time the monoalcohol is used in a quantity of from 10 to 50 parts by volume and preferably in a quantity of from 15 to 30 parts by volume to 100 parts by volume of oil phase.

The quantity of the monoalcohol employed has a positive effect upon the velocity and completeness of the esterification of the free fatty acids in the first stage of the process, although the solubility of the monoalcohol in the triglyceride is limited and is taken as constant for a given reaction temperature. Nevertheless, it has been found that the free fatty acids can be esterified more quickly and more completely by increasing the quantity of monoalcohol. However, it is advisable for reasons of cost to impose an upper limit to the quantity of monoalcohol, as already indicated, in the preliminary esterification stage, because considerable costs are involved in regenerating the excess alcohol.

The preliminary esterification stage may be carried out in batches or even continuously. Where it is carried out continuously, the starting materials, i.e. for example methanol, glycerol and oil phase, may be passed through in parallel flow and also in counterflow. Where counterflow is used, the mixture of monoalcohol and liquid entraining agent is passed through in counterflow to the oil phase.

The subsequent phase separation of the reaction product from the preliminary esterification stage is easy to carry out by virtue of the difference in density between the two phases. A simple settling vessel may normally be used for this purpose.

Removal of the water of reaction and, if desired, the excess alcohol from the entraining agent phase by distillation is carried out in known manner. Finally, transesterification of the deacidified, esterified oil in the presence of an alkaline catalyst is also carried out in known manner, cf. the prior art literature cited at the beginning.

The following Examples illustrate certain embodiments of the process according to the invention, but are not to be considered limitative:

EXAMPLE 1

200 liters (174 kg) of coconut oil, acid number 12, 50 liters of methanol, 20 liters of glycerol and 1.6 kg of p-toluene sulfonic acid were refluxed for 30 minutes with stirring in a 400 liter stirrer-equipped vessel. The reaction mixture was then left standing for some time at 50° to 60° C., separating cleanly into an oil phase and a glycerol phase.

The oil phase (195 kg) separated off contained 10.2% by weight of methanol and had an acid number of 0.8. From the sulfur content of the oil phase (26 ppm), it can be calculated, taking into account the sulfur content of the coconut oil used (12 ppm), that more than 99% by weight of the p-toluene sulfonic acid used remained in the glycerol phase.

In addition to 45% by weight of methanol, the glycerol phase (45 kg) separated off contained 1.3% by weight of water (0.58 kg), which corresponds to 92% by weight of the water of reaction formed through esterification in the reduction of the acid number from 12 to 0.8. The glycerol phase was freed from methanol and water by distillation, 20 kg of a methanol containing 2.8% by weight of water accumulating as distillate. The distillation residue of the glycerol phase (25 kg) had an acid number of 20.6, corresponding to 99% by weight of the p-toluene sulfonic acid used.

Transesterification of the oil phase to the corresponding methyl esters was carried out at 60° to 65° C. in the presence of 0.35 kg of sodium methylate (in the form of a 30% solution in methanol) and 20 liters of methanol. A two-phase reaction mixture (methyl ester phase and glycerol phase) was formed. The upper phase (methyl ester phase) was subsequently washed with water. In the crude methyl ester thus freed from residues of methanol and glycerol, the degree of conversion was determined through the content of bound glycerol. The degree of conversion of the crude methyl ester amounted to 97%.

EXAMPLE 2

The distillation residue of the glycerol phase, which had been obtained in the preliminary esterification stage in Example 1, was reacted while stirring and refluxing with 200 liters of coconut oil (acid number 12) and 40 liters of methanol without any addition of fresh glycerol and fresh catalyst. The oil phase thus obtained had an acid number of 0.7 and a sulfur content of 28 ppm.

The glycerol phase was worked up in the same way as in Example 1. The residue of the glycerol phase (acid number 20.2) was repeatedly used in 9 successive reactions without any further addition of glycerol or catalyst. The activity of the recycled p-toluene sulfonic acid in the preliminary esterification reaction was still high. The p-toluene sulfonic acid was recovered substantially quantitatively with the glycerol phase.

EXAMPLE 3

Following the procedure of Example 1, 200 liters of coconut oil (acid number 14) were reacted with 50 liters of methanol and 20 liters of glycerol over a period of 30 minutes in the presence of 0.8 kg of methane sulfonic acid. The oil phase obtained in this preliminary esterification stage had an acid number of 0.5. Acid analysis showed that more than 99% by weight of the methane sulfonic acid used was present in the glycerol phase obtained.

EXAMPLE 4

(a) The use of $C_{10}$–$C_{12}$-alkylbenzene sulfonic acids instead of p-toluene sulfonic acid (cf. Example 1) produced substantially the same results as the tests carried out with p-toluene sulfonic acid in regard to the acid number of the oil phase obtained, recovery of the catalyst, removal of the water of reaction and the degree of conversion.

(b) Entirely comparable results were also obtained where beef tallow was used as starting material in otherwise the same procedure as in Example 1.

EXAMPLE 5

Palm oil having an acid number of 14.5 was subjected to preliminary esterification in the same way as in Example 1, 40 liters of methanol, 20 liters of glycerol and 1.6 kg of p-toluene sulfonic acid being used to 200 liters of oil. Following separation of the glycerol phase, the oil phase obtained (acid number 0.7) was transesterified at 65° C. in the presence of 0.35 kg of sodium methylate and 15.8 kg of methanol. The crude methyl ester worked up in the same way as in Example 1 contained 0.4% by weight of bound glycerol. The degree of conversion of the triglyceride obtained amounted to 96%.

EXAMPLE 6

Coconut oil having an acid number of 14 was subjected to preliminary esterification in the same way as in Example 1, 50 liters of methanol, 1.6 kg of p-toluene sulfonic acid and, instead of glycerol, 25 liters of ethylene glycol being used to 200 liters of oil. Both here and in the subsequent transesterification stage carried out in the presence of sodium methylate as catalyst, the degrees of conversion obtained were substantially comparable with those obtained in Example 1.

EXAMPLE 7

Coconut oil having an acid number of 14 was subjected to preliminary esterification with ethanol in the same way as in Example 1, 40 liters of ethanol, 1.6 kg of p-toluene sulfonic acid and, instead of glycerol, 20 liters of polyethylene glycol having an average molecular weight of 600 being used to 200 liters of oil. The mixture was heated with stirring for 30 minutes to 80° C. The coconut oil obtained after separation of the glycerol phase had an acid number of 0.9. The coconut oil was then transesterified with ethanol at 80° C. in the presence of 0.2% by weight of KOH, based on the quantity of oil used, to form coconut oil fatty acid ethyl ester. The crude ethyl ester contained 0.7% by weight of bound glycerol.

EXAMPLE 8

The conversion of coconut oil into coconut oil fatty acid butyl ester was carried out by initially reacting 20 liters of coconut oil with 4 liters of butanol and 2 liters of glycerol while stirring at 120° C. in the presence of 0.2 kg of p-toluene sulfonic acid. After cooling to 80–90° C., the glycerol phase was separated off. The oil phase had an acid number of 0.8 and was subsequently transesterified with butanol in the presence of potassium hydroxide as catalyst to form the corresponding coconut oil fatty acid ester. The degree of conversion amounted to approximately 95%.

EXAMPLE 9

Coconut oil having an acid number of 16 was subjected to preliminary esterification with methanol by reacting 20 liters of coconut oil, 4 liters of methanol and 1.8 kg of polyethylene glycol having an average molecular weight of 3000 in the presence of 160 g of p-toluene sulfonic acid at a temperature of 100° C. and under a slight excess pressure (approx. 2 bars) in a closed stirrer-equipped vessel. After a reaction time of 15 minutes, the coconut oil phase had an acid number of 0.5. After cooling to 60° C., the polyethylene glycol phase was run off. The deacidified coconut oil was transesterified with methanol at 65° C. in the presence of 0.2% by weight of sodium methylate with a degree of conversion of 97%.

EXAMPLE 10

The conversion of coconut oil (acid number 16) into coconut oil fatty acid methyl ester was carried out in the same way as in Example 1, except that butyl glycol (butoxyethanol) was used instead of glycerol in the preliminary esterification stage. The results obtained in the preliminary esterification stage and in the subsequent transesterification stage were substantially the same as those obtained in Example 1.

EXAMPLE 11

(a) Propylene glycol was used instead of the glycerol used in Example 1 with equally good results.

(b) Instead of the p-toluene sulfonic acid used in Example 1, 98% by weight sulfuric acid in a quantity of 0.25% by weight, based on the coconut oil used, was used as catalyst in the preliminary esterification stage, the results obtained being as good as those obtained in Example 1.

(c) Instead of p-toluene sulfonic acid (Example 1), 12-phosphomolybdic acid in a quantity of 1% by weight, based on the coconut oil used, was used as the acidic catalyst for the preliminary esterification stage. In this case, too, it was possible to obtain sufficiently good preliminary esterification of the free fatty acids present in the coconut oil (acid number 16).

The preceding specific embodiments are illustrative of the practice of the invention. It is to be understood however, that other expedients known to those skilled in the art or disclosed herein may be employed without departing from the spirit of the invention or the scope of the appended claims.

We claim:

1. A process for the production of fatty acid esters of a $C_{1-6}$ aliphatic monoalcohol by catalytic transesterification consisting essentially of the steps of (a) subjecting natural fats and/or oils containing free fatty acids, as an oil phase, having an acid number of over 1, to preliminary esterification with a $C_{1-6}$ aliphatic monoalcohol in the presence of at least one acidic esterification catalyst at an elevated temperature no higher than 120° C. and under a pressure no higher than 5 bars, in the presence of a liquid entraining agent substantially immiscible with said oil phase, said liquid entraining agent being an alcohol, liquid at 50° C., selected from the group consisting of alkanepolyols having from 2 to 6 carbon atoms and 2 to 6 hydroxyls, polyethylene glycols, ethylene glycol mono-$C_{1-6}$-alkyl ethers and diethylene, glycol mono-$C_{1-6}$-alkyl ethers, for a time sufficient to reduce the free fatty acid content of said oil phase to an acid number of 1 or below, (b) separating the reaction product by phase separation into an entraining agent phase containing the acidic esterification catalyst and the water of reaction, and the treated oil phase, (c) subjecting the separated treated oil phase to transesterification with a $C_{1-6}$ aliphatic monoalcohol under conventional alkali-catalyzed transesterification conditions and recovering said fatty acid esters of $C_{1-6}$ aliphatic monoalcohols and (d) partially to wholly removing the water of reaction from said entraining agent phase and recycling said dried entraining agent phase containing the acidic esterification catalyst to a further preliminary esterification step.

2. The process of claim 1 wherein, in the preliminary esterification step, the free fatty acid content of said treated oil phase is reduced to an acid number of below 1.

3. The process of claim 1 wherein said entraining agent is glycerol.

4. The process of claim 2 wherein said entraining agent is glycerol.

5. The process of claim 1 wherein said preliminary esterification is conducted at a temperature of from 40° C. to 120° C.

6. The process of claim 1 wherein said preliminary esterification is conducted at a temperature of from 50° C. to 100° C. under normal pressure.

7. The process of claim 2 wherein said preliminary esterification is conducted at a temperature of from 50° C. to 100° C. under normal pressure.

8. The process of claim 4 wherein said preliminary esterification is conducted at a temperature of from 50° C. to 100° C. under normal pressure.

9. The process of claim 1 wherein said $C_{1-6}$ aliphatic monoalcohol is a $C_{1-4}$ alkanol.

10. The process of claim 9 wherein said $C_{1-4}$ alkanol is methanol.

11. The process of claim 2 wherein said $C_{1-6}$ aliphatic monoalcohol is a $C_{1-4}$ alkanol.

12. The process of claim 11 wherein said $C_{1-4}$ alkanol is methanol.

13. The process of claim 1 wherein said oil phase consists of commercial-grade natural fats and/or oils having acid numbers of up to 60.

14. The process of claim 2 wherein said oil phase consists of commercial-grade natural fats and/or oils having acid numbers of up to 60.

15. A process for the production of fatty acid esters of $C_{1-4}$-alkanols by catalytic transesterification consisting essentially of the steps of (a) subjecting commercial-grade natural fats and/or oils containing free fatty acids and having an acid number in excess of 1 up to 60, as an oil phase, to preliminary esterification with a $C_{1-4}$ alkanol in the presence of at least one acidic esterification catalyst at a temperature of from 40° C. to 120° C. and under a pressure no higher than 5 bars, in the presence of a liquid entraining agent substantially immiscible with said oil phase, being an alcohol, liquid at 50° C., selected from the group consisting of alkanepolyols having from 2 to 6 carbon atoms and 2 to 6 hydroxyls, polyethylene glycols, ethylene glycol mono-$C_{1-6}$-alkyl ethers and diethylene glycol mono-$C_{1-6}$-alkyl ethers, for a time sufficient to reduce the free fatty acid content of said oil phase to an acid number of below 1, (b) separating the reaction product by phase separation into an entraining agent phase containing the acidic esterification catalyst and the water of reaction, and the treated oil phase, (c) subjecting the separated treated oil phase to transesterification with a $C_{1-4}$-alkanol under conventional alkali-catalyzed transesterification conditions and recovering said fatty acid esters of $C_{1-4}$-alkanols, and (d) partially to wholly removing the water of reaction from said entraining agent phase and recycling said dried entraining agent phase containing the acidic esterification catalyst to a further preliminary esterification step.

16. The process of claim 15, step (a), wherein said $C_{1-4}$-alkanol is methanol and said liquid entraining agent is glycerol.

17. The process of claim 15, step (a) wherein said acidic esterification catalyst is present in an amount of from 0.5 to 5.0% by weight, based on the oil phase.

18. The process of claim 15, step (a) wherein said liquid entraining agent is present in an amount of from 5 to 50 parts by volume per 100 parts by volume of oil phase and said $C_{1-4}$-alkanol is present in an amount of from 10 to 50 parts by volume per 100 parts by volume of oil phase.

19. The process of claim 18 wherein said liquid entraining agent is present in an amount of from 5 to 25 parts by volume per 100 parts by volume of oil phase and said $C_{1-4}$-alkanol is present in an amount of from 15 to 30 parts by volume per 100 parts by volume of oil phase.

20. The process of claim 17 wherein said liquid entraining agent is present in anamount of from 5 to 50 parts by volume per 100 parts by volume of oil phase and said $C_{1-4}$-alkanol is present in an amount of from 10 to 50 parts by volume per 100 parts by volume of oil phase.

* * * * *